US008550569B2

(12) United States Patent
Wöhrstein et al.

(10) Patent No.: US 8,550,569 B2
(45) Date of Patent: Oct. 8, 2013

(54) SHANK CHISEL

(75) Inventors: Thomas Wöhrstein, Aichhalden (DE); Thomas Lehnert, Oberraden (DE)

(73) Assignee: Betek Bergbau- und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 601 days.

(21) Appl. No.: 12/451,991

(22) PCT Filed: May 30, 2008

(86) PCT No.: PCT/EP2008/004303

§ 371 (c)(1),
(2), (4) Date: Apr. 5, 2010

(87) PCT Pub. No.: WO2009/003561

PCT Pub. Date: Jan. 8, 2009

(65) Prior Publication Data

US 2010/0194177 A1 Aug. 5, 2010

(30) Foreign Application Priority Data

Jul. 2, 2007 (DE) ..... 10 2007 030 658

(51) Int. Cl.
*E21C 35/197* (2006.01)

(52) U.S. Cl.
USPC ..... 299/105; 299/107

(58) Field of Classification Search
USPC ..... 299/105, 107
See application file for complete search history.

(56) References Cited

U.S. PATENT DOCUMENTS

| | | | | |
|---|---|---|---|---|
| 4,149,753 | A * | 4/1979 | Stoltz et al. | 299/107 |
| 4,755,003 | A * | 7/1988 | Pinkerton et al. | 299/107 |
| 4,944,559 | A * | 7/1990 | Sionnet et al. | 299/105 |
| 8,099,847 | B2 * | 1/2012 | Hahn et al. | 29/252 |
| 2005/0088034 | A1 * | 4/2005 | Clemenson | 299/106 |
| 2007/0132304 | A1 | 6/2007 | Holl et al. | |
| 2007/0257545 | A1 * | 11/2007 | Mouthaan et al. | 299/107 |
| 2008/0283150 | A1 | 11/2008 | Essig et al. | |
| 2009/0019679 | A1 | 1/2009 | Hahn et al. | |
| 2009/0293249 | A1 | 12/2009 | Lehnert et al. | |

FOREIGN PATENT DOCUMENTS

| | | |
|---|---|---|
| DE | 30 26 930 A1 | 10/1981 |
| DE | 20 2007 010 047 U1 | 10/2007 |
| GB | 2 328 961 | 3/1999 |
| WO | WO 97/23710 | 7/1997 |
| WO | WO 2005/005119 | 1/2005 |

* cited by examiner

*Primary Examiner* — John Kreck
(74) *Attorney, Agent, or Firm* — Pauley Petersen & Erickson

(57) ABSTRACT

A shank chisel including a chisel head and a chisel shank, wherein the chisel shank bears a clamping sleeve in which the chisel shank is held captively in a direction of a longitudinal axis and is freely rotatably about the longitudinal axis. To allow the shank chisel to be both assembled and disassembled through a chisel receptacle of a chisel holder that is formed as a receiving bore, according to this invention, the chisel shank bears at its end remote from the chisel head a shank extension, the shank extension has a tool receptacle, and the tool receptacle is accessible by way of a spacing region of the shank extension in the axial direction of the chisel that is set back from the lateral surface of the chisel shank and/or from the lateral surface of the clamping sleeve.

17 Claims, 2 Drawing Sheets

SHANK CHISEL

BACKGROUND OF THE INVENTION

1. Field of the Invention

This invention relates to a shank chisel including a chisel head and a chisel shank. The chisel shank has a clamping sleeve in which the chisel shank is secured in captive fashion in a direction of a longitudinal axis and is able to rotate freely around its longitudinal axis.

2. Discussion of Related Art

Shank chisels of this kind are known. They are usually used in mining machines, road milling machines, and the like for stripping asphalt, rock, and the like. The shank chisels are mounted in chisel holders that are secured to a milling roller of the machine. The chisel holders have a bore acting as a chisel receptacle. The chisel shank is inserted with its clamping sleeve into the chisel receptacle. As a result, the clamping sleeve clamps against the inner wall of the chisel receptacle in a spring-elastic fashion. In the clamping sleeve, the shank chisel is secured in captive fashion in a direction of its longitudinal axis, but is able to rotate freely around its longitudinal axis.

When the tool is in use, a chisel tip secured to the chisel head is guided across the surface to be stripped and as a result, wears along with the chisel head. When the wear limit is reached, the shank chisel must be replaced. To overcome the clamping force of the clamping sleeve, an axial force must be introduced into the shank chisel. Various tools that can be used for this purpose are known from the prior art. For example, PCT International Publication WO 97/23710 discloses a tool in which a pin-shaped pushing section is coupled to a handle by an articulation. The tool is used for removing a shank chisel. To accomplish this, the pushing section is slid through the rear opening of the chisel receptacle and brought into contact with the free end of the chisel shank. The handle can then be swiveled until it comes into contact with a support section. Then in the articulation, the handle can be moved in relation to the pushing section. The pushing section introduces the resulting leverage forces into the chisel so that the locking of the clamping sleeve is released. When the shank chisel is removed and the tool is withdrawn, a new, unworn shank chisel can be placed against the receiving bore and driven into place with a hammer. With the known system, replacing a shank chisel is labor-intensive and cannot be carried out safely in cramped conditions.

German Patent Reference DE 30 26 930A1 discloses other detaching devices that require a ram, which is mounted in the region of the receiving bore for the shank chisel. The ram can be moved in linear fashion against the shank end of the shank chisel so that the latter can be moved out of the receiving bore.

SUMMARY OF THE INVENTION

One object of this invention is to provide a shank chisel of the type mentioned above but which can be installed and removed through the chisel receptacle.

This object is attained if at its end remote from the chisel head, the chisel shank has a shank extension. The shank extension has a tool fitting accessible in the axial direction of the chisel by way of a gap region of the shank extension that is set back from the circumference surface of the chisel shank and/or from the circumference surface of the clamping sleeve.

This construction ensures that an actuating element of a tool can be guided in the gap region. For the removal of a shank chisel, a tool extension is inserted into the tool fitting and a section of the actuating element adjoining the tool extension is guided through the gap region. The gap region makes it possible for the actuating element to be guided through the receiving bore when the tool extension is inserted into the tool fitting. It is thus possible to use the actuating element for both installing and removing the shank chisel through the receiving bore.

According to one embodiment of this invention, the gap region is formed between the circumference surface of the cylindrical chisel shank, which has a first diameter, and an end section of the shank extension, which has a second diameter, with the second diameter being smaller than the first diameter. The gap region is situated in the vicinity of the diameter offset. If in addition, the central longitudinal axes of the chisel shank and the end section are aligned with each other and the gap region is composed of the annular space produced between the first and second diameter, then the tool fitting is circumferentially accessible, which facilitates attaching the tool to the shank chisel.

The tool fitting can be composed of or include a circumferential groove that permits the shank chisel to be easily produced as a turned part.

According to one embodiment of this invention, the shank extension has a pull-in section and a push-out section that are oriented transversely to the central longitudinal axis of the chisel shank. This produces recessed form surfaces extending transverse to the installation and removal directions, which permit a form-locked engagement for a safe installation and removal.

To permit the tool to be inserted safely into the tool fitting of the shank chisel even in cramped conditions and blind locations, a shank chisel according to this invention can be embodied so that the chisel shank and/or the shank extension each is conveyed into the tool fitting via a chamfer.

To facilitate the installation work, it is possible to provide an embodiment in which a wear-protection disk is pulled onto the clamping sleeve and holds the clamping sleeve in a prestressed state. The wear-protection disk can be slid off from the clamping sleeve in the direction toward the chisel head. When it has been slid off, the wear-protection disk is situated in a transition section of the chisel shank, which is formed between the chisel head and the clamping sleeve, and releases the clamping sleeve. The clamping sleeve prestressed by the wear-protection disk can easily be installed using the tool according to this invention.

BRIEF DESCRIPTION OF THE DRAWINGS

This invention is explained in view of an exemplary embodiment shown in the drawings, wherein.

DETAILED DESCRIPTION OF THE INVENTION

Figure 1:
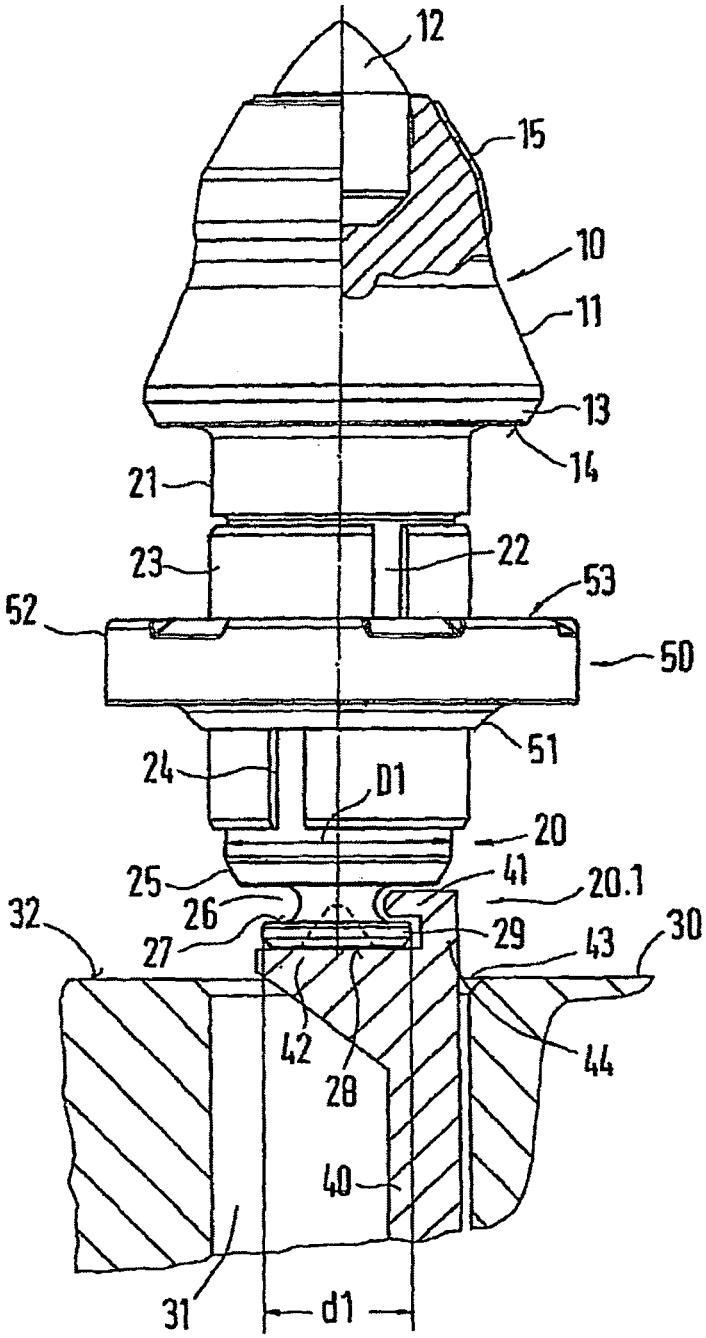
FIG. 1 is a partial sectional side view of a shank chisel, prepared for installation in a chisel holder.

FIG. 1 shows a shank chisel with a chisel head 10 and a chisel shank 20. The chisel head 10 has a receptacle into which a chisel tip 12 is inserted and therein soldered in place. The chisel tip 12 can be comprised of hard metal. Adjoining the chisel tip 12, the chisel head 10 has lateral deflecting surfaces 11. When the tool is in use, stripped stone material flows past the recesses 16. In the region closer to the chisel tip 12, the deflecting surfaces 11 are covered with an armoring 15, which is embodied in the form of a welded coating. The chisel head 10 is thus protected in this particularly wear-prone region.

In the transition region of the chisel head 10 to the chisel shank 20, the chisel head 10 has a collar 13. The collar forms a downward-oriented support surface 14. A cylindrical transition section 21 adjoins the rotationally symmetrical collar 13. A holding section 22 also embodied as a cylinder is formed onto the transition section 21. At its free end, the holding section 22 transitions via a chamfer 25 into a shank extension 20.1. The shank extension 20.1 is provided with a circumferential groove that serves as a tool fitting 26. Adjacent to the groove, the shank extension 20.1 terminates at an end section 29. The end section 29 at the free end of the shank constitutes or forms a flat contact surface that serves as the push-out section 28. The wall of the tool fitting 26 closer to the push-out section 28 constitutes or forms a pull-in section 27.

A clamping sleeve 23 is slid onto the holding section 22 of the chisel shank 20. The cylindrical clamping sleeve 23 is formed out of a rolled segment of sheet metal. The clamping sleeve 23 has a slit 24 that extends in the longitudinal direction of the clamping sleeve 23 and can extend in an offset fashion, as shown.

The clamping sleeve 23 has holding elements that protrude in the direction toward the chisel shank. The holding elements are not shown in FIG. 1. The holding elements engage in a circumferential groove of the holding section 22. The clamping sleeve 23 is thus able to freely rotate in the circumferential direction, but is secured in captive fashion in the axial direction of the shank chisel.

Figure 2:
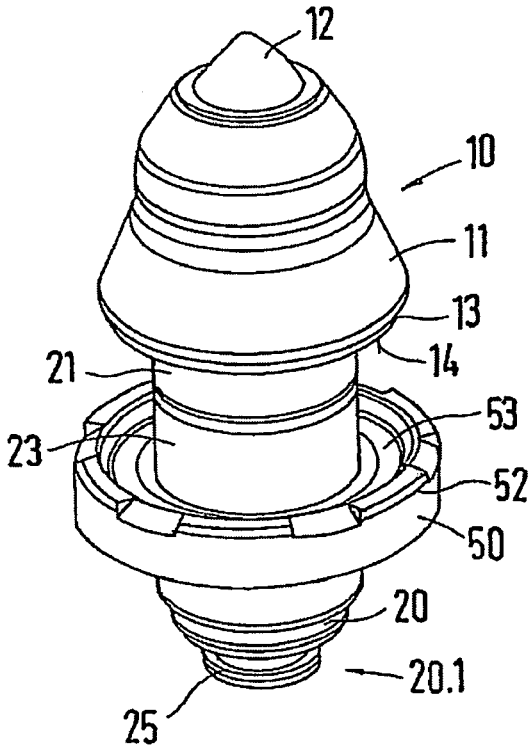
FIG. 2 is a perspective view of the chisel holder according to FIG. 1.

A wear-protection disk 50 is pulled onto the clamping sleeve 23. The wear-protection disk 50 has a bore into which the clamping sleeve 23 is moved. The inner diameter of the bore here is slightly smaller than the outer diameter of the clamping sleeve 23 in its relaxed state. If the wear-protection disk 50 is then pulled onto the clamping sleeve 23, the outer diameter of the clamping sleeve 23 decreases, thus shifting it into a prestressed state. As shown in FIG. 2, the wear-protection disk 50 is embodied as a turned part. The wear-protection disk 50 has a circumferential wall 52 that delimits a dish 53. A shoulder 51 embodied in the form of a chamfer protrudes from the underside of the wear-protection disk 50. The wear-protection disk 50 can be slid toward the chisel head 10 in the axial direction of the shank chisel and when it reaches the region of the transition section 21, the wear-protection disk 50 releases the clamping sleeve 23, allowing the latter to snap open radially.

The shank chisel can be mounted in a chisel receptacle 31, embodied in the form of a bore, of a chisel holder 30 which can be executed with the aid of a tool. The tool has an actuating element 40 that forms a recess between a shoulder 42 and a claw 41. The claw 41 engages in the tool fitting 26 of the shank chisel while the shoulder 42 rests against the push-out section 28. The actuating element 40 of the tool is guided through the receiving bore 31, which is formed as a through bore, of the chisel holder 30.

The shoulder 42 and the claw 41 or are connected by bridge piece 44 that is embodied so that it can be guided between the inner wall of the chisel receptacle 31 and the end section 29. For this purpose, the end section 29 is set back from the circumference surface of the holding section 22 or chisel shank and from the circumference surface of the clamping sleeve 23 because it has a smaller diameter than the holding section 22 and the clamping sleeve 23.

The resulting recessed gap region provides access to the tool fitting 26 in the axial direction of the shank chisel, beyond the end section 29. Thus, the shank chisel can be pulled in through the receiving bore 31 by the actuating element 40. During the pull-in procedure, the clamping sleeve 23 comes into contact with a chamfer 43 of the chisel holder 30, and the chamfer 43 encompasses the chisel receptacle 31. As the pull-in procedure continues, the clamping sleeve 23 is then compressed radially inward in the receiving bore 31 and the chamfer 43. Then the wear-protection disk 50 comes into contact with the support surface 32 of the chisel holder 30. As a result, the wear-protection disk 50 slides toward the chisel head 10 until it travels into the region of the transition section 21 and, as described above, releases the clamping sleeve 23. The clamping sleeve 23 snapping radially outward then clamps against the inner wall of the chisel receptacle 31. In this position, the collar 13 comes to rest in the dish 53 of the wear-protection disk 50.

If the shank chisel has reached its wear limit, it can be removed from the chisel holder 30 again by the tool. To accomplish this, the actuating element 40 is inserted with its claw 41 into the tool fitting 26. Because in this state, the shoulder 42 is resting against the push-out section 28, the shank chisel can be slid out from the receiving bore 31 by exerting force on the actuating element 40.

This overcomes the friction force that the clamping sleeve 23 produces between the receiving bore 31 and the outer surface of the clamping sleeve 23. When the shank chisel reaches its detached position shown in FIG. 1, it can be removed from the actuating element 40.

In order to enable a simple insertion of the actuating element 40 into the tool fitting 26 for an intended detachment of the shank chisel, it is advantageous if the shank extension 20.1 is secured outside of the chiseling receptacle 31. For this purpose, the chisel receptacle 31 is formed as a through bore. The shank extension 20.1 then protrudes beyond the mouth of the bore oriented away from the chisel head 10.

It is also possible for the shank extension 20.1 to be secured inside the chisel receptacle 31. Care must then be taken to assure that the claw 41 can be guided through the gap region between the end section 29 and the wall of the chisel receptacle 31 so that it can be inserted into the tool fitting 26.

The invention claimed is:

1. A shank chisel for mounting in a chisel receptacle, comprising:

a chisel head (10):

a chisel shank (20) connected to the chisel head (10), the chisel shank having a first diameter (D1);

a shank extension (20.1) at an end of the chisel shank (20) remote from the chisel head (10), the shank extension (20.1) including an end section (29) and a tool fitting (26) disposed between the end section (29) and the chisel shank (20); and the end section (29) having a second diameter (d1) that is smaller than the first diameter (D1) to form a gap region, wherein the tool fitting (26) is accessible in the chisel receptacle by a tool in the axial direction of the shank chisel by the gap region formed by the end section (29) being set back from a circumference surface of the chisel shank (20), wherein the tool comprises an actuating element with a tool extension adapted to fit within the tool fitting (26), and a shoulder adapted to contact an end surface of the end section (29) when the tool extension is within the tool fitting.

2. The shank chisel as recited in claim 1, wherein a central longitudinal axis of the chisel shank (20) and the end section (29) are aligned with each other and the gap region is formed by an annular space between the first diameter (D1) and the second diameter (d1).

3. The shank chisel as recited in claim 2, wherein the tool fitting (26) is a circumferential groove.

4. The shank chisel as recited in claim 3, wherein the shank extension (20.1) has a pull-in section (27) and a push-out section (28) oriented transversely to the central longitudinal axis of the chisel shank.

5. The shank chisel as recited in claim 4, wherein the chisel shank (20) and/or the shank extension (20.1) each is conveyed into the tool fitting (26) via a chamfer (25).

6. The shank chisel as recited in claim 5, wherein a wear-protection disk (50) is pulled onto the clamping sleeve (23) and holds the clamping sleeve (23) in a prestressed state and the wear-protection disk (50) can slide off from the clamping sleeve (23) in the direction toward the chisel head (10); and when slid off the wear-protection disk (50) is situated in a transition section (21) of the chisel shank (20), which is formed between the chisel head (10) and the clamping sleeve (23) and releases the clamping sleeve (23).

7. The shank chisel as recited in claim 6, wherein adjoining the chisel tip (12), the chisel head (10) has lateral deflecting surfaces (11) which in a region closer to the chisel tip (12) are covered with an armoring (15) formed as a welded coating.

8. The shank chisel as recited in claim 7, wherein in the transition region of the chisel head (10) to the chisel shank (20) the chisel head (10) has a collar (13) adjoined by a cylindrical transition section (21) for accommodating a wear-protection disk (50).

9. The shank chisel as recited in claim 8, wherein a wear-protection disk (50) has a circumferential wall (52) which delimits a dish (53) and a collar (13) of the chisel head (10) is accommodated in the dish (53).

10. The shank chisel as recited in claim 1, wherein the tool fitting (26) is a circumferential groove.

11. The shank chisel as recited in claim 1, wherein the shank extension (20.1) has a pull-in section (27) and a push-out section (28) oriented transversely to the central longitudinal axis of the chisel shank.

12. The shank chisel as recited in claim 1, wherein the chisel shank (20) and/or the shank extension (20.1) each is conveyed into the tool fitting (26) via a chamfer (25).

13. The shank chisel as recited in claim 1, wherein a wear-protection disk (50) is pulled onto the clamping sleeve (23) and holds the clamping sleeve (23) in a prestressed state and the wear-protection disk (50) can slide off from the clamping sleeve (23) in the direction toward the chisel head (10); and when slid off the wear-protection disk (50) is situated in a transition section (21) of the chisel shank (20), which is formed between the chisel head (10) and the clamping sleeve (23) and releases the clamping sleeve (23).

14. The shank chisel as recited in claim 1, wherein adjoining the chisel tip (12), the chisel head (10) has lateral deflecting surfaces (11) which in a region closer to the chisel tip (12) are covered with an armoring (15) formed as a welded coating.

15. The shank chisel as recited in claim 1, wherein in the transition region of the chisel head (10) to the chisel shank (20) the chisel head (10) has a collar (13) adjoined by a cylindrical transition section (21) for accommodating a wear-protection disk (50).

16. The shank chisel as recited in claim 1, wherein a wear-protection disk (50) has a circumferential wall (52) which delimits a dish (53) and a collar (13) of the chisel head (10) is accommodated in the dish (53).

17. The shank chisel as recited in claim 1, wherein the chisel shank (20) comprises a clamping sleeve (23) in which the chisel shank (20) is secured in a captive fashion in a direction of a longitudinal axis and is freely rotatable around the longitudinal axis, the clamping sleeve (23) having holding elements that engage in a circumferential groove of a holding section (22) of the chisel shank (20) thus securing the clamping sleeve freely rotatable but secured in the captive fashion in an axial direction of the shank chisel (20), wherein the gap region of the shank extension (20.1) is formed by the end section (29) set back from a circumference surface of the clamping sleeve (23).

* * * * *